US005368126A

United States Patent [19]

Woodward et al.

[11] Patent Number: 5,368,126

[45] Date of Patent: Nov. 29, 1994

[54] ADJUSTABLE WORK PLATFORM

[76] Inventors: Wilbur W. Woodward, Rte. 1, Box 54I, Colwich, Kans. 67034; James D. Woodward, S. Hwy. D, Crane, Mo. 65633

[21] Appl. No.: 38,029

[22] Filed: Mar. 29, 1993

[51] Int. Cl.[5] ..... E04G 1/34

[52] U.S. Cl. ..... 182/152; 182/223; 182/118

[58] Field of Search ..... 182/152, 223, 119, 153, 182/118

[56] References Cited

U.S. PATENT DOCUMENTS 1,832,537 11/1931 Erwin ..... 182/152
2,446,005 7/1948 Hartmann ..... 182/152
4,427,093 1/1984 Wehmeyer ..... 182/141
4,630,819 12/1986 Levin ..... 182/152 X
4,967,733 11/1990 Rousseau ..... 182/141 X

FOREIGN PATENT DOCUMENTS 2218725 11/1989 United Kingdom ..... 182/152

*Primary Examiner*—Alvin C. Chin-Shue
*Attorney, Agent, or Firm*—Chase & Yakimo

[57] ABSTRACT

A portable work platform is provided having a height adjustable platform work surface and leg assemblies which may be locked into an open, use-position and unlocked to fold into a collapsed storage position.

17 Claims, 3 Drawing Sheets

Fig. 5
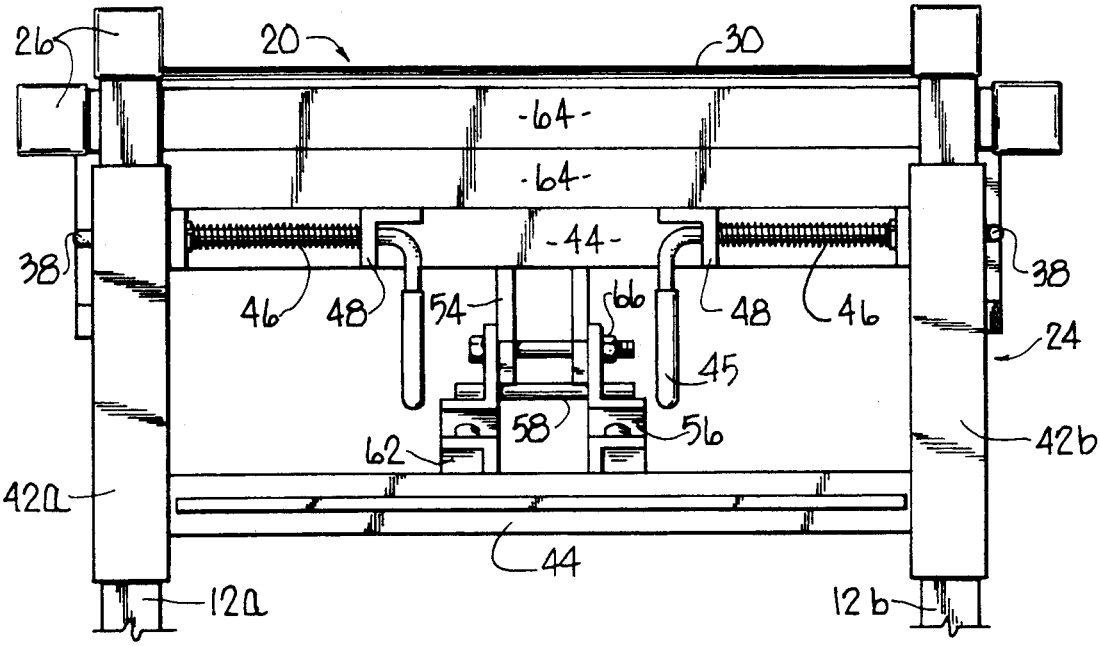
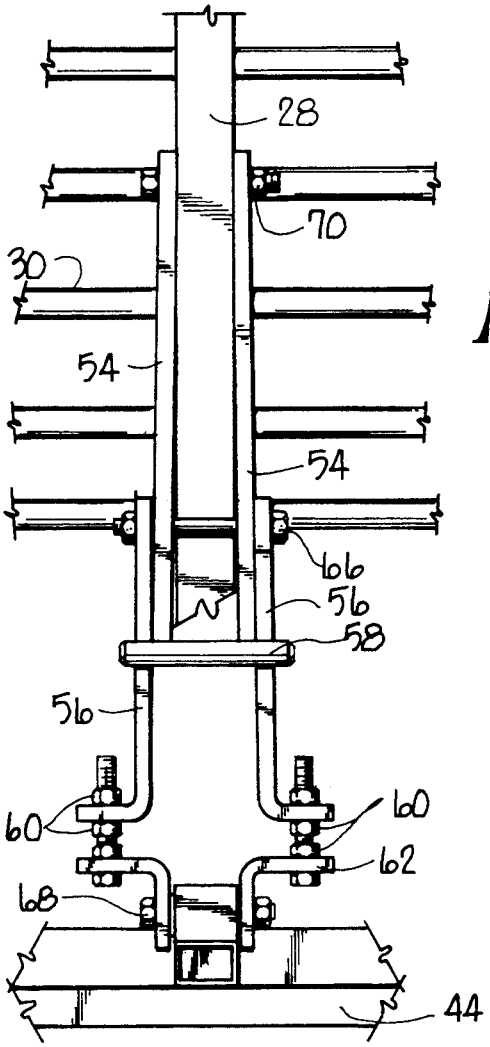
Fig. 6

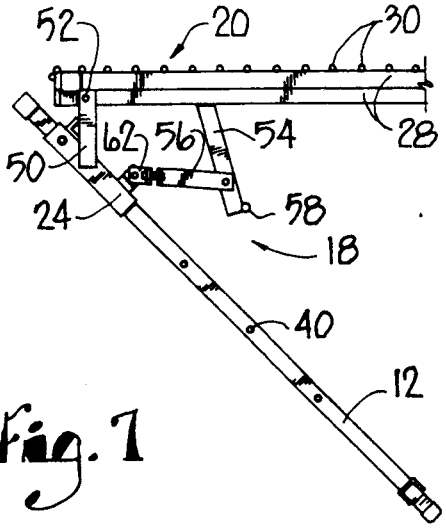
Fig. 7
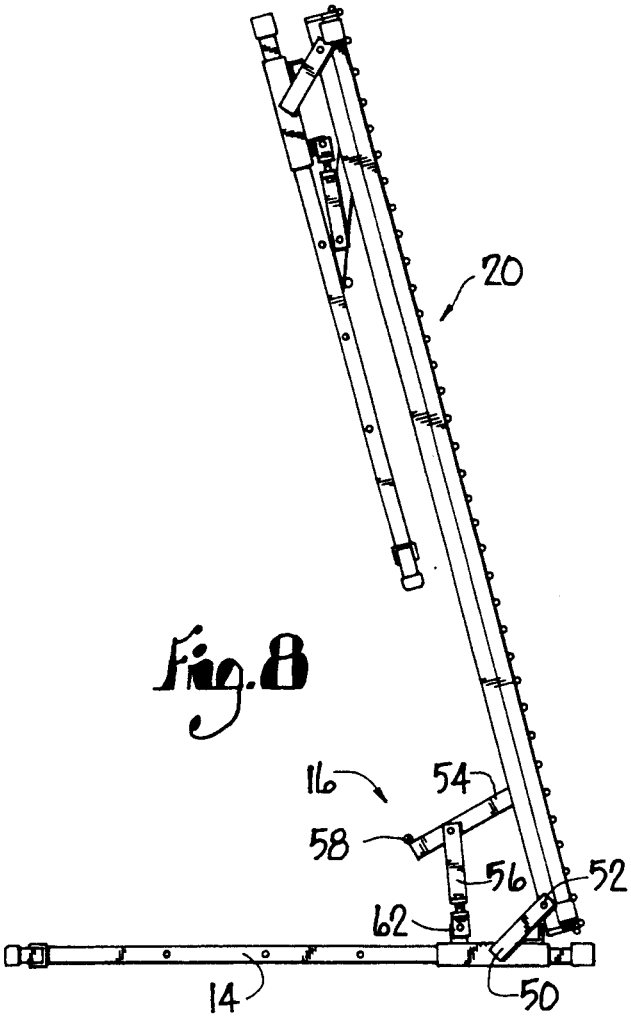
Fig. 8
Fig. 9
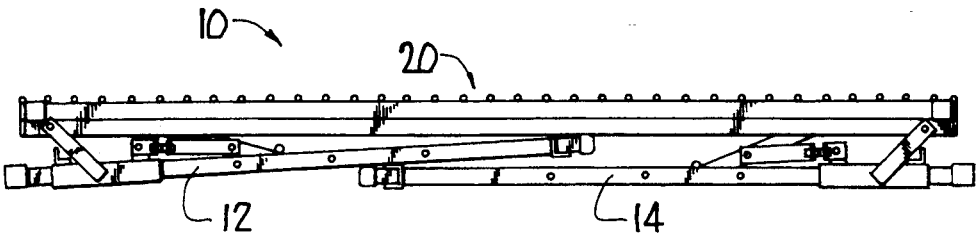

ADJUSTABLE WORK PLATFORM

This invention relates to structures for supporting workers in close proximity to a vehicle. In particular, the present invention relates to a collapsible, height-adjustable work platform which may be positioned next to a vehicle to permit a worker to stand and/or sit while working on the roof and upper side-portions of a vehicle.

BACKGROUND OF THE INVENTION

In the area of automotive auto body work it is frequently necessary to perform auto body damage repairs on the roof and upper portions of a vehicle. This locus of work has increased with the popularity of vans for family use and with the popularity four wheel vehicles. These vehicles present a high roof-line, in comparison to the standard passenger car or sedan, which is difficult to reach.

Therefore, a need has arisen for a lightweight, collapsible, height-adjustable work platform which can be positioned near such a vehicle to allow a worker to perform auto body procedures on the upper sidewalls of such vehicles as well as the roof. In the past it has been the common practice to utilize a step ladder for elevating a worker. However, these types of apparatus are limited in that the worker is unable to move a sufficient distance laterally to work on nearby damaged areas. The worker must dismount the ladder and reposition it each time a new area is to be worked. Further, as ladders are constructed in a triangular fashion the worker may be several feet distant from the automobile by the time the appropriate height is reached. If the ladder is situated sideways and adjacent to the vehicle the worker must turn at an inconvenient angle to operate on the roof of the vehicle. Most importantly, the worker has little freedom of movement and can easily loose balance and fall from the ladder.

Therefore, it is an object of the present invention to provide a work platform which may be positioned closely to the side of a vehicle while situating a worker at an appropriate preselected height to permit convenient work on the roof and upper sidewalls of the vehicle;

Another object of the present invention is to provide a lightweight, easily moveable work platform which may be moved and operated by a single individual;

Yet another object of the present invention is to provide a collapsible work platform which may be stored conveniently when not in use;

Another object of the present invention is to provide a work platform which is height adjustable without moving or dismantling the work platform;

Yet another object of the present invention is to provide a work platform which permits a worker access to nearly the entire length of a van or four wheel vehicle roof without repositioning the work platform; and Yet another object of the present invention is to provide a height adjustable work platform having stable support legs which may be locked into an upright position for stability while permitting vertical adjustment of the platform height.

Other objects and advantages of this invention will become apparent from the following description taken in connection with the accompanying drawings, wherein is set forth by way of illustration and example, an embodiment of this invention.

DESCRIPTION OF THE DRAWINGS

FIG. 5 is an enlarged fragmentary view of FIG. 2 showing the collar which joins the platform surface to the leg assembly and showing the collar securing pins which allow release of the collar for movement of the platform surface into an alternate height position;

FIG. 6 is an enlarged fragmentary view taken along line 6—6 of FIG. 1 showing the lock mechanism for securing the leg assemblies in the open, use-position;

FIG. 7 is a fragmentary side elevational view of the work platform of FIG. 1 and showing the released lock mechanism and partial collapse of one leg assembly toward the closed, storage-position;

FIG. 8 is a front elevational view of the work platform, resting on one end, and showing a first leg assembly in the closed, storage-position and the leg lock mechanism released for collapse of the second leg assembly into the closed, storage-position; and FIG. 9 is a front elevational view of the work platform with both legs in the closed, storage-position.

DESCRIPTION OF THE INVENTION

Figure 1:
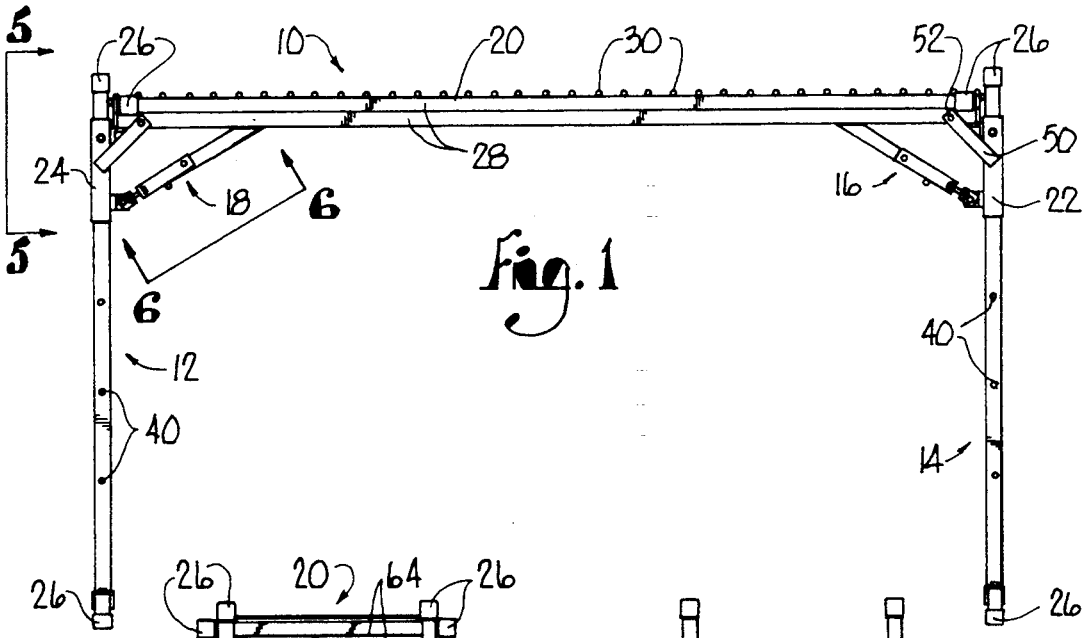
FIG. 1 is a front elevational view of the platform with the platform surface in its highest position and the legs locked into the open, use-position.

The use and general operation of the platform will now be discussed. Referring to FIG. 1, work platform 10 is shown in its use-position with leg assemblies 12 and 14 in the open, use-position. Leg assemblies 12, 14 are retained in the open, use-position by leg locks 16, 18. platform surface 20 is joined to leg assemblies 12, 14 by slideable collars 22, 24.

Figure 2:
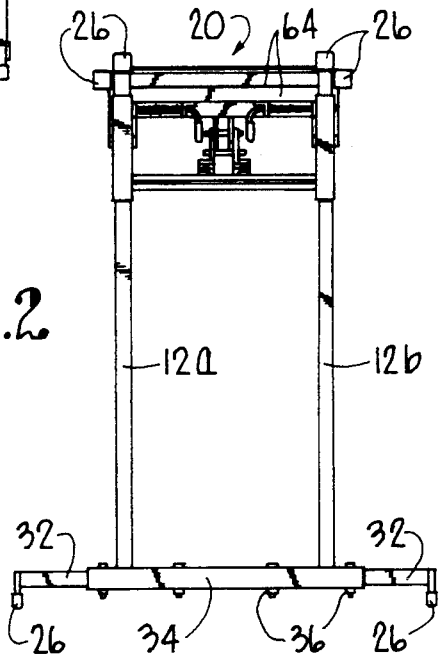
FIG. 2 is a side elevational view of the work platform shown in FIG. 1.
Figure 3:
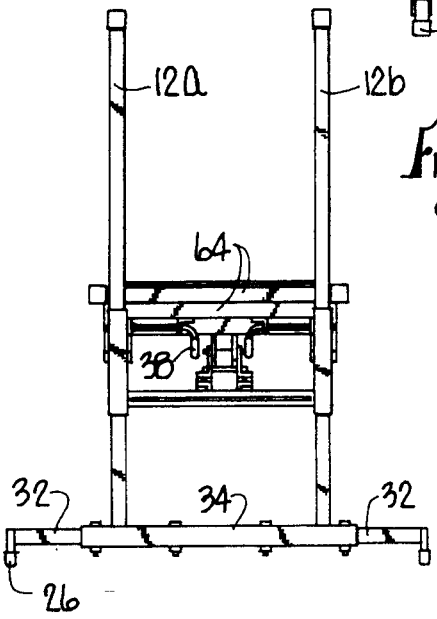
FIG. 3 is a side elevational view of the work platform of FIG. 2 with the platform surface lowered to an alternate work height.

Referring to FIGS. 2 and 3, work platform 10 of FIG. 1 is shown in side elevational view. FIGS. 2 and 3 illustrate the vertical movement of platform surface 20 from full height position, illustrated in FIG. 2, to a lowered position illustrated in FIG. 3. It will be observed that during the course of vertical movement of platform surface 20 that the collars 22, 24 and locks 16, 18 move along the longitudinal axis of leg assemblies 12, 14. The operation of the vertical movement of platform surface 20 will be discussed, in detail, herein.

Referring now to FIGS. 1, and 7 thru 9 the transformation of work platform 10 from use-position to storage-position will be described. In FIG. 1, platform 10 is shown in the use-position with leg assemblies 12, 14 upright. When it is desired to store work platform 10, leg assemblies 12, 14 may be collapsed and folded parallel to platform surface 20 to provide a compact, easily manageable unit for storage. In FIGS. 7 thru 9, the procedure for collapsing legs assemblies 12, 14 is illustrated. In FIG. 7, lock 18 is shown in the released position which allows leg assembly 12 to be collapsed against leg assembly 12 and platform surface 20. In FIG. 8, lock 16 is shown in its released position allowing leg assembly 14 to be collapsed against platform surface 20. In FIG. 9, leg assemblies 12 and 14 have been collapsed and rest parallel to platform surface 20 thus providing a compact easily manageable unit which may be carried by a single worker or stored in a minimum of space.

Referring again to FIG. 1, work platform 10 is illustrated in its upright position with leg assemblies 12, 14 locked into position for use. This locking of leg assemblies 12, 14 provides a stable platform upon which a worker can walk back and forth while performing repair tasks to a vehicle. If convenient the worker may sit upon platform surface 20 in order to more conveniently access the sides of the vehicle. Protective caps 26 are provided on leg assemblies 12, 14, stabilizer feet 26, and platform surface 20 to protect both worker and vehicle from the projecting surfaces of work platform 10. Work platform 10, in its preferred embodiment, is constructed of tubular aluminum. This provides a sturdy, but lightweight unit which should have projecting surfaces protected in order to avoid worker injury and harm to the adjacent vehicle.

Figure 4:
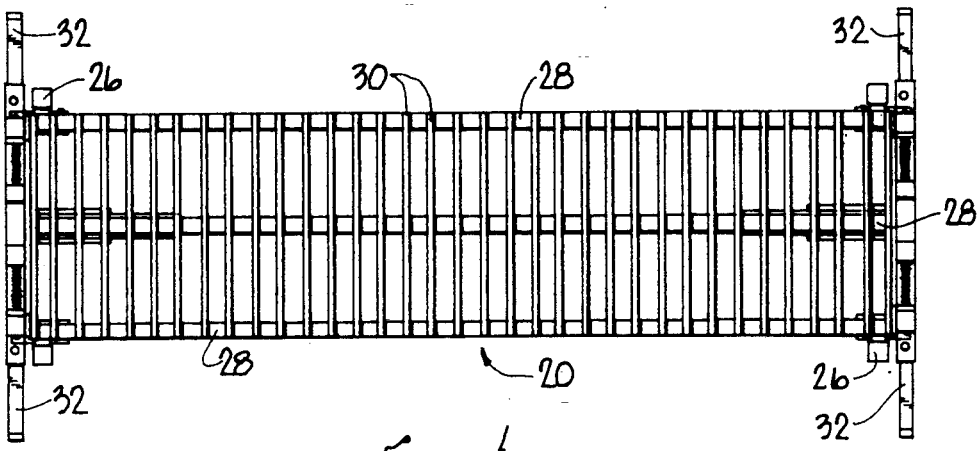
FIG. 4 is top plan view of the work platform of FIG. 1 showing the stabilizing feet extended and the individual tread rods of the platform surface.

Referring to FIG. 4, platform surface 20 is illustrated in plan view. Platform surface 20 is comprised of multiple longitudinal support beams 28 attached on either end to cross beams 64 (FIG. 2). Across support beams 28 are treads 30. In the preferred embodiment, treads 30 are aluminum rods which have a grooved upper surface to provide secure traction for the worker. It will be appreciated that in the automotive repair shop it is very likely the floor of the shop will be contaminated by grease and oil or other fluids. A worker will accumulate these contaminates on the sole of the shoe. If platform surface 20 were a smooth unitary surface, such as sheet aluminum, it would be easy for the worker to slip on platform surface 20. In addition, the use of separated treads 30 reduces the overall weight of work platform 10 resulting in a lighter, more portable structure.

Stability is an important feature of inventive work platform 10. The lightweight tubular aluminum construction permits ease of handling of the structure by a single worker, but provides sufficient strength for two or more workers to stand on work platform 10. Stability is imparted to work platform 10 through securely locking leg assemblies 12, 14 into the use-position with locks 16, 18. Lateral stability is imparted to work platform 10 by stabilizer feet 32 (FIGS. 2–4). Stabilizer feet 32 are joined to leg assemblies 12, 14 by insertion into leg assembly base 34. Stabilizer feet 32 may be telescoped in and out of leg assembly base 34 by the release of bolts 36. This telescoping of stabilizer feet 32 permits a user to impart additional lateral stability to work platform 10. Stabilizer feet 32 may be completely collapsed into leg assembly base 34 in order to additionally compact the structure of work platform 10.

The raising and lowering of platform surface 20 will now be described. Referring to FIG. 2, platform surface 20 is illustrated in its elevated position. Platform surface 20 may be lowered from the position illustrated in FIG. 2 to a variety of other heights along the longitudinal axis of leg assemblies 12, 14. Height adjustment of platform surface 20 is accomplished by the release of collar securing pins 38 from apertures 40 (FIG. 1) on each of leg assemblies 12, 14. This permits platform surface 20 and collars 22, 24 to slide up and down along the longitudinal axis of leg assemblies 12, 14. When the desired height of platform surface 20 is achieved, collar securing pins 38 are reinserted into apertures 40 of leg assemblies 12, 14. Apertures 40 occur at 6 inch intervals along leg assemblies 12, 14. However, should an alternate height be desired, additional apertures may be drilled by the user in leg assemblies 12, 14. In this manner, a precise and convenient height of platform surface 20 may be provided for either the specific user or specific application.

Referring now to FIG. 5, collar assembly 24 is shown in enlarged view. Collar 24 is comprised of sleeves **42*a*, 42*b* which are slideably mounted about the exterior of uprights 12*a*, 12*b* of leg assembly 12. Sleeves 42*a*, 42*b* are connected by cross braces 44 which stabilize the platform structure and allow sleeves 42*a*, 42*b* to move along the longitudinal axis of uprights 42*a*, 42*b* simultaneously. In FIG. 5 collar 24 is illustrated locked into the upper most position with respect to leg assembly 12. Collar securing pins 38 are shown protruding from apertures 40 and serve to secure collar 24 and attached platform surface 20** in position.

When it is desired to change the height of platform surface 20, collar securing pins 38 are pulled from registration within apertures 40 (FIG. 1) leaving collar 24 free to slide along the longitudinal axis of uprights **12*a*, 12*b* of leg assembly 12. Handle 45 is provided to allow withdrawal of collar securing pins 38 from apertures 40. Retaining spring 46 is compressed between bracket 48 and sleeve 42*a*, 42*b* and attached to pin 38 in order to positively retain securing pin 38 within aperture 40 until released by a user. Once collar securing pins 38 have been removed from apertures 40, platform surface 20 may be moved from a first position (FIG. 2) into a second position (FIG. 3). Collar securing pins 38 are then reinserted through apertures 40 in leg assemblies 12, 14 to secure platform surface 20** at the newly selected height.

The securing of leg assemblies 12, 14 in the open or use-position is accomplished by folding the legs outwardly, as illustrated in FIGS. 7 and 8, from the collapsed position of FIG. 9 and into the open or use-position illustrated in FIG. 1. This pivots leg assemblies 12, 14 about pivot 52 attached between hinge arm 50 and platform surface 20. Hinge arm 50 is fixed to each of collar sleeves **42*a*, 42*b* of collars 22, 24 and pivotally attached to platform surface 20. As leg assemblies 12, 14 are moved into the open position locks 16, 18** move toward position for locking.

Referring to FIGS. 8 and 1, it can be observed that to fix leg assemblies 12, 14 in the use-position arms 54, 56 of locks 16, 18 pivot about arm connector 66 and are brought into alignment so the longitudinal axis of each arm is parallel with the other (FIG. 1). Referring to FIG. 6, arm 54 has one end pivotally attached to the central longitudinal beam of platform surface 20 by arm pivot 70. The other end of arm 54 is pivotally attached to an end of arm 56 by arm connector 66. The other end of arm 56 is attached by compression adjustment bolt 60 to flange 62. Flange 62 is pivotally attached by flange pivot 68 to collar 24, 22. As the angle between arm 54 and arm 56 approaches 180°, arms 54, 56 become compressed against one another and it is necessary for the user to press upwardly against release bar 58 in order to fix arms 54, 56 into the parallel locked position. In this position the angle between arms 54, 56 is 180°.

Referring now to FIG. 6, compression adjustment bolts 60 permit a user to adjust the amount of compression required to set arms 54, 56 into the parallel locked position. To adjust the amount of compression required to set arms 54, 56, the user applies a wrench to compression adjustment bolts 60 and lengthens or shortens the distance between arm 56 and flange 62. In this manner, the amount of compression required to force arms 54, 56 into the 180° locked angle can be increased to the level that release of locks 16, 18 will not occur inadvertently.

When it is desired to release leg assemblies 12, 14 from the open, use-position so they may be folded into the closed storage-position, a user pulls downwardly on release bar 58 attached to arm 54 (FIG. 6) to overcome the compression of arm 56 between arm 54 and flange 62. Leg assemblies 12, 14 can then be moved inwardly, on pivot 52 of hinge arm 50, to collapse leg assemblies 12, 14 against platform surface 20 in the manner illustrated in FIGS. 7 thru 9.

It is to be understood that while certain forms of this invention have been illustrated and described, it is not limited thereto except insofar as such limitations are included in the following claims and allowable functional equivalents thereof.

Having thus described the invention what is claimed as new and desired to be secured by Letters Patent is as follows:

1. A portable work platform comprising:

a platform surface for supporting a user thereon, a leg assembly for supporting said surface above ground level, collar means connecting said leg assembly with said surface, said collar means being slideably attached to said leg assembly for adjustment of the distance of said surface above ground level, hinge means for movement of said leg assembly between an open, use-position, and a closed, storage-position, lock means for securing said leg assembly in said open position and for stabilizing said surface when in use, and collar securing means for fixing said collar means in a user selected position on said leg assembly to permit said user to locate said surface at a user selected distance from said ground level, said lock means comprising first and second arms pivotally interconnected at a first end, a second end of said first arm being pivotally connected to said surface, a second end of said second arm being connected to a flange which is pivotally connected to said collar means, and means for adjustment of the distance between said second arm and said flange such that as said first arm and second arm pivot into parallel relation said arms compressively lock said leg assembly in an upright position.

2. The platform as claimed in claim 1, wherein said platform surface is comprised of spaced apart tread segments spanning a support frame.

3. The platform as claimed in claim 1, wherein said leg assembly comprises:

an upright for supporting said surface, and a stabilizer projecting from a base of said upright to stabilize said platform.

4. The platform as claimed in claim 3, wherein said stabilizer is extensible from said upright base to permit adjustment of the length of said stabilizer and the degree of stability provided to said work platform.

5. The platform as claimed in claim 1, wherein said collar means is a sleeve surrounding said leg assembly, said sleeve being adapted for movement along the longitudinal axis of said leg assembly to adjust the distance of said surface above ground level.

6. The platform as claimed in claim 1, wherein said hinge means is a bar having a first end fixed to said collar means and a second end pivotally connected to said surface to permit movement of said leg assembly between said open and said closed positions.

7. The platform as claimed in claim 1, wherein said collar securing means comprises an aperture in said collar means registrable with an aperture in said leg assembly, and a securing pin for insertion through said registered apertures to position and secure said platform surface at a user selected distance above said ground level.

8. The platform as claimed in claim 1, wherein said means for adjustment comprises a threaded connector between said flange and said second arm to permit lengthening or shortening of the distance therebetween.

9. A portable work platform comprising:

a platform surface having spaced apart treads for supporting a user thereon, a leg assembly for supporting said surface above ground level, a foot extensible from said leg assembly for stabilizing said leg assembly while supporting said platform surface, collar means connecting said leg assembly with said surface, said collar means being slideably attached to said leg assembly for adjustment of the distance of said surface above ground level, hinge means for movement of said leg assembly between an open, use-position, and a closed, storage-position, lock means for securing said leg assembly in said open position and for stabilizing said surface when in use, and collar securing means for fixing said collar means in a user selected position on said leg assembly to permit said user to locate said surface at a user selected distance from said ground level, said lock means comprising first and second arms pivotally interconnected at a first end, a second end of said first arm being pivotally connected to said surface, a second end of said second arm being connected to a flange which is pivotally connected to said collar means, and means for adjustment of the distance between said second arm and said flange such that as said first arm and second arm pivot into parallel relation, said arms compressively lock said leg assembly in an upright position.

10. The platform as claimed in claim 9, wherein said collar means is a sleeve surrounding said leg assembly, said sleeve being adapted for movement along the longitudinal axis of said leg assembly to adjust the distance of said surface above ground level.

11. The platform as claimed in claim 9, wherein said collar securing means comprises an aperture in said collar means registrable with an aperture in said leg assembly, and a securing pin for insertion through said registered apertures to position and secure said platform surface at a user selected distance above said ground level.

12. The platform as claimed in claim 9, wherein said hinge means is a bar having a first end fixed to said collar means and a second end pivotally connected to said surface to permit movement of said leg assembly between said open and said closed positions.

13. A portable work platform comprising:

a platform surface having spaced apart treads for supporting a user thereon, a leg assembly for supporting said surface above ground level, a foot extensible from said leg assembly for stabilizing said leg assembly while supporting said platform surface, a sleeve joining said leg assembly to said surface, said sleeve adapted for slideable movement along the longitudinal axis of said leg assembly to adjust the distance of said surface above ground level, hinge means for movement of said leg assembly between an open, use-position, and a closed, storage-position, lock means for securing said leg assembly in said open position and for stabilizing said surface when in use, comprising:

first and second arms pivotally interconnected at a first end, a second end of said first arm pivotally connected to said surface, a second end of said second arm connected to a flange, said flange being pivotally connected to said sleeve, means for adjustment of the distance between said second arm and said flange such that as said first arm and second arm pivot into parallel relation, said arms compressively lock said leg assembly in an upright position, and securing means for fixing said sleeve in a user selected position on said leg assembly to permit said user to locate said surface at a user selected distance from said ground level.

14. The platform as claimed in claim 13, wherein said leg assembly comprises:

an upright for supporting said surface, and a stabilizer projecting from a base of said upright presenting said foot to stabilize said platform.

15. The platform as claimed in claim 13, wherein said hinge means is a bar having a first end fixed to said sleeve and a second end pivotally connected to said surface to permit movement of said leg assembly between said open and said closed positions.

16. The platform as claimed in claim 13, wherein said securing means comprises an aperture in said sleeve registrable with an aperture in said leg assembly, and a securing pin for insertion through said registered apertures to position and secure said platform surface at a user selected distance above said ground level.

17. The platform as claimed in claim 13, wherein said means for adjustment comprises a threaded connector between said flange and said second arm to permit lengthening or shortening of the distance therebetween.

* * * * *